United States Patent [19]

Cook et al.

[11] Patent Number: 4,715,340

[45] Date of Patent: Dec. 29, 1987

[54] REDUCTION OF HC EMISSIONS FOR VAPOR RECOVERY PURGE SYSTEMS

[75] Inventors: Jeffrey A. Cook, Dearborn; Douglas R. Hamburg, Birmingham, both of Mich.

[73] Assignee: Ford Motor Company, Dearborn, Mich.

[21] Appl. No.: 45,659

[22] Filed: May 4, 1987

[51] Int. Cl.[4] ..... F02P 5/04; F02M 25/08

[52] U.S. Cl. ..... 123/406; 123/520

[58] Field of Search ..... 123/406, 407, 415, 416, 123/417, 518–520

[56] References Cited

U.S. PATENT DOCUMENTS

| | | | |
|---|---|---|---|
| 3,680,318 | 8/1972 | Nakajima et al. . | |
| 3,872,848 | 3/1975 | King . | |
| 4,013,054 | 3/1977 | Balsley et al. . | |
| 4,031,869 | 6/1977 | Onishi et al. . | |
| 4,275,697 | 6/1981 | Stoltman . | |
| 4,308,842 | 1/1982 | Watanabe et al. . | |
| 4,326,489 | 4/1982 | Heitert . | |
| 4,377,142 | 3/1983 | Otsuka et al. . | |
| 4,411,241 | 10/1983 | Ishida . | |
| 4,450,808 | 5/1984 | Moriyama et al. | 123/417 |
| 4,527,532 | 7/1985 | Kasai et al. . | |
| 4,630,581 | 12/1986 | Shibata . | |
| 4,641,623 | 2/1987 | Hamburg | 123/518 |
| 4,664,087 | 5/1987 | Hamburg | 123/520 |
| 4,677,956 | 7/1987 | Hamburg | 123/520 |

FOREIGN PATENT DOCUMENTS

| | | |
|---|---|---|
| 86555 | 5/1982 | Japan . |
| 131343 | 5/1983 | Japan . |

OTHER PUBLICATIONS

SAE 82066, "Measurement and Improvement of the Transient A/F Characteristics of an Electronic Fuel Injection System", Hamburg et al. (1982).

*Primary Examiner*—Tony M. Argenbright

*Attorney, Agent, or Firm*—Allan J. Lippa; Peter Abolins

[57] ABSTRACT

An apparatus and a method for controlling hydrocarbon emission from an internal combustion engine having an air/fuel intake coupled to a fuel vapor recovery system. Fuel vapors are periodically purged from the fuel vapor recovery system into the air/fuel intake. The mixture of air/fuel vapor and fuel is regulated by a feedback loop response to an exhaust gas oxygen sensor to maintain a desired air/fuel ratio. At the beginning of each purge cycle, engine spark timing is temporarily retarded to reduce hydrocarbon emissions during the response time of the feedback loop.

13 Claims, 3 Drawing Figures

REDUCTION OF HC EMISSIONS FOR VAPOR RECOVERY PURGE SYSTEMS

BACKGROUND OF THE INVENTION

The field of the invention relates to controlling the level of hydrocarbon emissions from an internal combustion engine. More specifically, the invention relates to controlling hydrocarbon emissions which may result by purging the fuel vapors from a fuel vapor recovery system into the internal combustion engine.

Motor vehicles of recent years are required to have a fuel vapor recovery system to reduce the amount of fuel vapors released into the atmosphere. Typically, a canister containing a fuel vapor absorbing material, such as activated charcoal, is coupled between the fuel system and the air/fuel intake of the engine. A purge valve positioned between the canister and air/fuel intake enables the periodic purging of fuel vapors from the canister dependent upon engine operating parameters. Systems of this type are disclosed in U.S. Pat. No. 4,308,842 issued to Watanabe et al, U.S. Pat. No. 4,326,489 issued to Heitert, U.S. Pat. No. 4,377,142 issued to Otsuka et al, and U.S. Pat. No. 4,411,241 issued to Ishida.

A problem with these recovery systems is that the purged fuel vapors inducted into the engine may alter the air/fuel ratio thereby increasing hydrocarbon emissions. An approach directed to this problem is disclosed in both U.S. Pat. No. 4,013,054 issued to Balsley et al and Japanese Pat. No. 57-86555 by Yanagisowa, wherein the purge flow rate is regulated in response to a feedback signal indicative of the oxygen level in the engine exhaust.

The inventors herein have recognized that limiting the purge flow rate in response to an exhaust feedback signal does not solve the problem of hydrocarbon emissions described hereinabove. More specifically, the propogation time from the engine air/fuel intake to the engine exhaust delays the required correction to the purge flow rate. Accordingly, when a vapor purge is first initiated, the increase in hydrocarbon emissions caused by induction of fuel vapors cannot be corrected for a predetermined time. This perturbation in hydrocarbon emissions is dramatically increased in vehicles employing three-way catalytic converters (CO, HC, $NO_x$) which are designed to operate in a narrow range of air/fuel ratios referred to as stoichiometry. For example, a small decrease in air/fuel ratio from 14.7 to 14.6 may decrease the efficiency of the converter for removing hydrocarbons by approximately 20% (see SAE 82066, entitled "The measurement and Improvement of the Transient A/F Characteristics of an Electronic Fuel Injection System", by D. R. Hamburg and D. Klick, 1982). This disadvantage is particularly troublesome when vapor purge is frequently cycled, such as while driving in urban areas.

SUMMARY OF THE INVENTION

It is an object of the present invention to reduce hydrocarbon emissions which are caused by purging the fuel vapors from a fuel vapor recovery system into the internal combustion engine.

The invention described herein provides both an apparatus and a method for controlling hydrocarbon emissions from an internal combustion engine having an air/fuel intake coupled to a fuel vapor recovery system. In one embodiment in which the invention is used to advantage, the apparatus comprises means for providing engine spark timing, means for periodically purging fuel vapors from the fuel vapor recovery system into the air/fuel intake, and means coupled to the engine's spark timing means for retarding the engine spark timing whenever the fuel vapor purging is initiated and for advancing the engine spark time back to its timing before the purging was initiated. Thus, the burn time of the engine at the beginning of the purge cycle is prolonged. An advantage is thereby provided of mitigating any increase in hydrocarbon emissions which might otherwise occur at the beginning of a purge cycle.

DESCRIPTION OF THE PREFERRED EMBODIMENT

Figure 1:
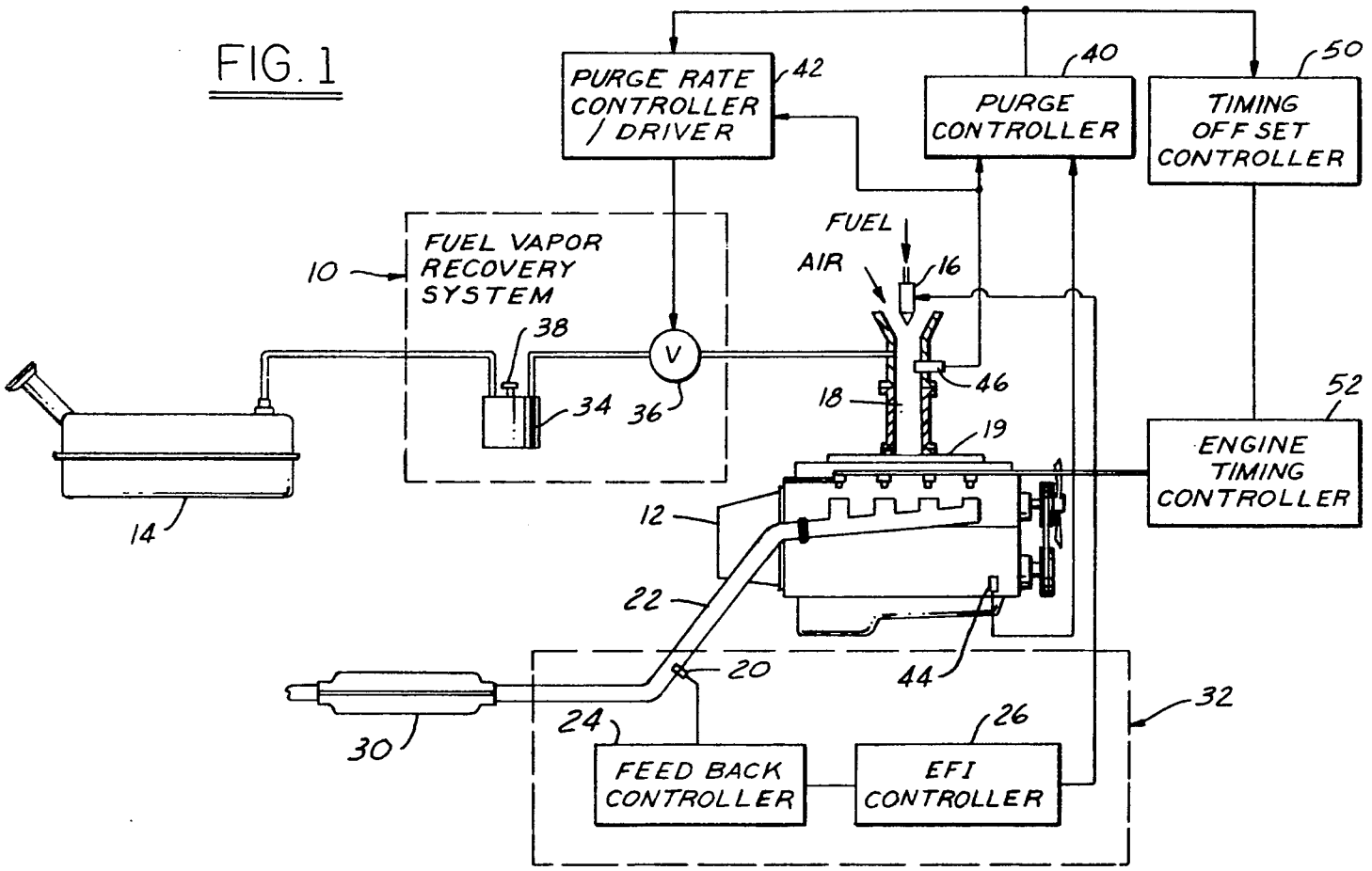
FIG. 1 shows a block diagram of an embodiment wherein the present invention may be used to advantage.

FIG. 1 shows fuel vapor recovery system 10 coupled between internal combustion engine 12 and fuel tank 14. Engine 12 is shown as an electronic fuel injected engine (EFI) wherein ambient air, fuel vapor from vapor recovery system 10, and fuel from injector 16 are inducted into engine 12 through air/fuel inlet 18 and air/fuel intake manifold 19.

Although the illustrated embodiment shows a fuel injected engine having a single injector, the invention described herein may be used to advantage with multiport fuel injected engines and also carbureted engines. Those skilled in the art will also recognize that the invention may be used to advantage with fuel vapor recovery systems connected directly to the air/fuel intake manifold.

For the embodiment shown, the inducted mixture of fuel vapor, air and fuel, referred to hereinafter as air/fuel mixture, is regulated by feedback loop 32 coupled between engine exhaust 22 and fuel injector 16. Feedback loop 32 is shown including the series interconnection of exhaust gas oxygen sensor (EGO) 20, feedback controller 24, and EFI controller 26. In operation, EFI controller 26 regulates the fuel injected by injector 16 in response to EGO sensor 20 for maintaining an air/fuel ratio within the operating window of three-way catalytic converter 30.

Fuel vapor recovery system 10 is shown having a canister 34, preferably containing a vapor absorbing material such as activated charcoal, coupled between a vapor outlet vent of fuel tank 14 and vapor purge valve 36. Canister 34 is also shown having an ambient air valve 38 for enabling ambient air to be inducted therethrough when purge valve 36 is opened. During a fuel vapor purge of fuel vapor recovery system 10, fuel vapors from both fuel tank 14 and canister 34 will be inducted into air/fuel inlet 18 of engine 12.

Those skilled in the art will recognize that although canister 34 is shown coupled in series to fuel tank 14, the invention described herein may also be used to advantage in systems wherein the canister is coupled in parallel to a fuel tank. The invention may also be used to advantage with fuel vapor recovery systems which are coupled to other components of a vehicle fuel system, such as a fuel reservoir. An example of a fuel reservoir is the carburetor bowl of a carbureted fuel system.

Continuing with FIG. 1, purge controller 40 is shown having inputs coupled to engine temperature sensor 44 and mass airflow sensor (MAF) 46 coupled to air/fuel inlet 18. In response to these inputs, purge controller 40 provides an actuating signal to purge rate controller/-driver 42 for actuating vapor purge valve 36 when a purge is desired. It has been found that it is preferable to commence a vapor purge when engine 12 has reached sufficient operating temperature such that a vapor purge will have a minimal effect on drivability. Further, the vapor purge is preferably initiated when there is sufficient inducted airflow to achieve a desirable air/fuel mixture.

Purge rate controller/driver 42 also controls the purge flow rate to be substantially proportional to the flow rate of air inducted into engine 12. More specifically, purge rate controller/driver 42 sequentially opens and closes vapor purge valve 36 in response to MAF sensor 46 during a vapor purge. Cnsequently, feedback loop 32 is able to more accurately maintain the desired air/fuel mixture. Stated another way, fluctuations in the inducted air/fuel mixture are minimized.

Timing offset controller is shown coupled between engine timing controller 52 and purge controller 40. Engine timing controller 52 provides engine spark timing for the spark plugs of engine 12 dependent upon crankshaft position, referred to herein as nominal timing. Algorithms may also be executed by engine timing controller 52 such as a timing algorithm for cold operating conditions. Those skilled in the art will recognize that timing offset controller 50 and engine timing controller 52 may be incorporated into a single controller. It will also be recognized that feedback controller 24 and EFI controller 26 may also be incorporated into a single controller.

Figure 2:
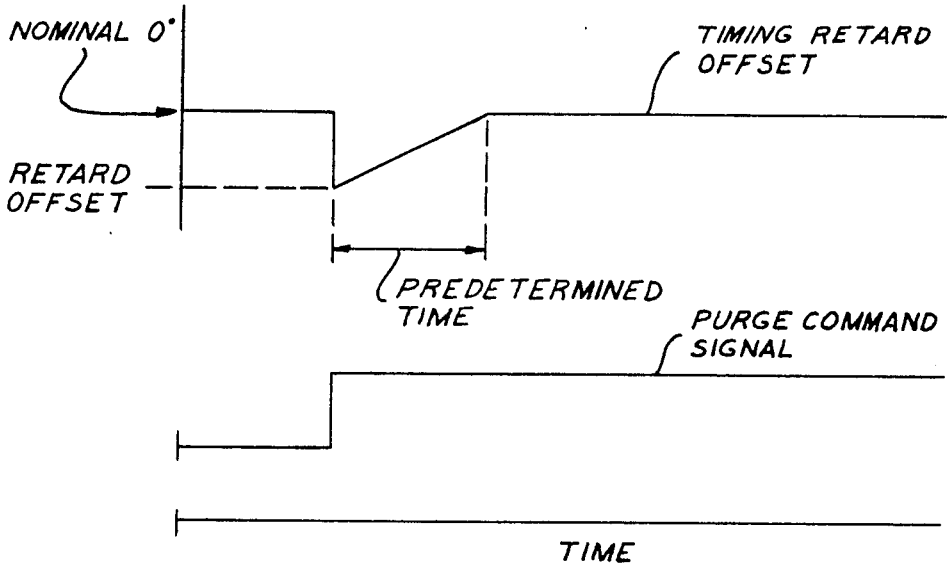
FIG. 2 illustrates the electrical wave forms associated with the operation of the embodiment shown in FIG. 1.

Referring now to FIG. 2, and continuing with FIG. 1, purge controller 40 also provides the purge command signal to timing offset controller 50 upon the initiation of a vapor purge. In response, timing offset controller 50 retards the engine spark timing a predetermined offset from nominal timing. During a predetermined time after the initiation of purge, timing offset controller 50 then gradually advances the engine spark timing at a predetermined rate back to the nominal engine timing.

Preferably, the predetermined time is substantially equal to the propogation delay of an inducted air/fuel charge through engine 12 to EGO sensor 20. Stated another way, the predetermined time is substantially equal to the time required for feedback loop 32 to correct for a perturbation in the air/fuel mixture inducted into an engine 12.

Figure 3:
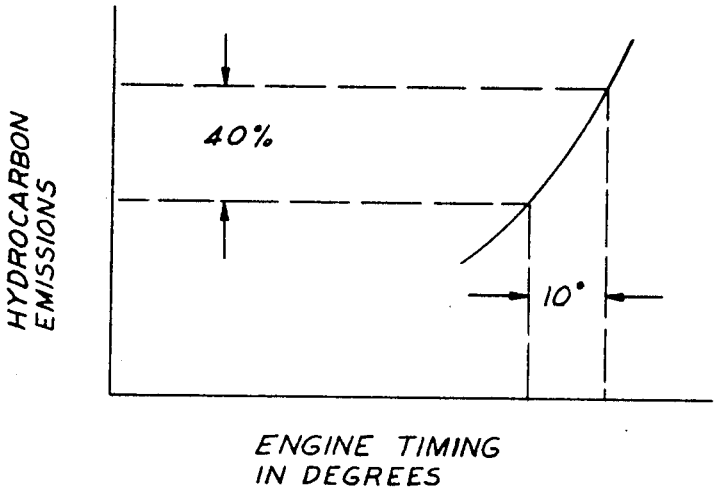
FIG. 3 is a graph illustrating the effectiveness of retarding engine spark timing in reducing hydrocarbon emissions.

In accordance with the above description, when a vapor purge is first initiated, a sharp increase in hydrocarbon emissions is avoided which would otherwise occur during the predetermined time required for correction by feedback loop 32. More specifically, by retarding engine spark timing a predetermined offset, the cylinder burn time is prolonged thereby reducing hydrocarbon emissions. The effect of retarding engine spark timing on hydrocarbon emissions is graphically illustrated by FIG. 3. For example, FIG. 3 illustrates that a 10° retard in timing reduces hydrocarbon emissions by 40% at an air/fuel ratio of 14.7.

The actual timing offset to be employed is a function of the purge vapor content, frequency of purge, desired engine performance, and desired emissions. It has been determined that a retard offset of 5° to 15° is desirable for most motor vehicles.

Another aspect of the embodiment described hereinabove, is that after the predetermined time has lapsed and feedback loop 32 is able to correct for the perturbation in the inducted air/fuel mixture, the timing has been gradually advanced back to its nominal value thereby avoiding unexpected changes in driving characteristics.

This concludes the description of the preferred embodiment. The reading of it by those skilled in the art will bring to mind many alterations and modifications without departing from the spirit and scope of the invention. Accordingly, it is intended that the scope of the invention be limited only by the following claims.

We claim:

1. A method for controlling hydrocarbon emissions from an internal combustion engine having an air/fuel intake coupled to a fuel vapor recovery system, comprising the steps of:
   - providing engine spark timing to said internal combustion engine;
   - periodically purging fuel vapors from said fuel vapor recovery system into said air/fuel intake;
   - retarding said engine spark timing whenever said step of purging is initiated; and
   - advancing said engine spark timing back to its timing before said step of purging was initiated.

2. The method recited in claim 1, wherein said step of periodically purging is initiated in response to the flow rate of air inducted into said air/fuel intake being beyond a threshold value.

3. The method recited in claim 2, wherein said step of periodically purging is initiated in response to engine operating temperature being beyond a threshold temperature.

4. The method recited in claim 1, wherein said step of retarding retards said engine spark timing by a predetermined timing offset whenever said step of purging is initiated.

5. The method recited in claim 1, wherein said step of advancing gradually advances said engine spark timing by said predetermined timing offset during a predetermined time after said step of retarding has been completed.

6. A method for controlling hydrocarbon emissions from an internal combustion engine having an air/fuel intake coupled to a fuel vapor recovery system comprising the steps of:
   - providing engine spark timing to said internal combustion engine;
   - regulating the air/fuel mixture inducted into said air/fuel intake in response to an exhaust gas oxygen sensor to maintain a predetermined level of hydrocarbon emissions;
   - periodically purging fuel vapors from said fuel vapor recovery system into said air/fuel intake;
   - retarding said engine spark timing by a predetermined timing offset each time said step of purging is initiated to provide additional burn time for said fuel vapors so that said regulating step is able to maintain said predetermined level of hydrocarbon emissions during said purging step; and
   - gradually advancing said engine spark timing by said predetermined timing offset during a predetermined time after said step of retarding has been completed, said engine spark timing thereby being advanced back to its timing before said step of purging was initiated.

7. The method recited in claim 6, wherein said predetermined time is approximately equal to the propogation delay of a charge of air and fuel through said engine to said exhaust gas oxygen sensor.

8. An apparatus for controlling hydrocarbon emissions from an internal combustion engine having an air/fuel intake coupled to fuel vapory recover system, comprising:

means for providing engine spark timing to said internal combustion engine;

means for periodically purging fuel vapors from said fuel vapor recovery system into said air/fuel intake; and means coupled to said engine spark timing means for retarding said engine spark timing whenever said purging is initiated and for advancing said engine spark timing back to its timing before said purging was initiated.

9. An apparatus for controlling hydrocarbon emissions from an internal combustion engine having an air/fuel intake coupled to a fuel vapor recovery sytem, comprising:

a controller for providing engine spark timing to said internal combustion engine;

an exhaust gas oxygen sensor coupled to the exhaust of said internal combustion engine;

means for regulating the air/fuel mixture inducted into said air/fuel intake in response to said exhaust gas oxygen sensor to maintain a predetermined level of hydrocarbon emissions;

means for periodically purging fuel vapors from said fuel vapor recovery system into said air/fuel intake; and timing means coupled to said controller for retarding said engine spark timing by a predetermined timing offset each time said purging is initiated to provide additional burn time for said fuel vapors so that said regulating means is able to maintain said predetermined level of hydrocarbon emissions during said purging of said fuel vapors, said timing means also gradually advancing said engine spark timing by said predetermined timing offset during a predetermined time after said step of retarding has been completely thereby advancing said engine spark timing back to its timing before said purging was initiated.

10. The apparatus recited in claim 9, wherein said predetermined time is approximately equal to the propogation delay of a charge of air and fuel through said engine to said exhaust gas oxygen sensor.

11. The apparatus recited in claim 9, wherein said purging means is responsive to the flow rate of air inducted into said air/fuel intake.

12. The apparatus recited in claim 9, wherein said purging means is responsive to the temperature of said internal combustion engine.

13. The apparatus recited in claim 11 wherein said purging means further comprises controlling means for controlling the flow rate of the purged fuel vapors to be proportional to the flow rate of the air inducted into said air/fuel intake.

* * * * *